US008073566B2

(12) United States Patent
Messinger et al.

(10) Patent No.: US 8,073,566 B2
(45) Date of Patent: Dec. 6, 2011

(54) AUTOMATED STRINGLINE INSTALLATION SYSTEM

(75) Inventors: Dwight Ferrand Messinger, Salisbury, NC (US); Fred Russell Humphries, Mocksville, NC (US); John Charles Colvard, Wilkesboro, NC (US)

(73) Assignee: Power Curbers, Inc., Salisbury, NC (US)

( * ) Notice: Subject to any disclaimer, the term of this patent is extended or adjusted under 35 U.S.C. 154(b) by 856 days.

(21) Appl. No.: 12/098,428

(22) Filed: Apr. 5, 2008

(65) Prior Publication Data

US 2008/0253835 A1 Oct. 16, 2008

Related U.S. Application Data

(60) Provisional application No. 60/910,247, filed on Apr. 5, 2007, provisional application No. 60/910,243, filed on Apr. 5, 2007, provisional application No. 60/910,251, filed on Apr. 5, 2007.

(51) Int. Cl.
*G06F 19/00* (2011.01)

(52) U.S. Cl. ..... 700/245; 700/257; 700/258; 404/84.8; 404/84.1; 404/84.2; 180/84; 180/9.46; 180/168; 180/401

(58) Field of Classification Search ..... 700/245, 700/257, 258; 404/84.8, 84.1, 84.2; 180/131, 180/9.46, 98, 53, 686, 84, 401, 168
See application file for complete search history.

(56) References Cited

U.S. PATENT DOCUMENTS 3,763,567 A * 10/1973 Hudis ..... 33/1 LE
4,185,712 A * 1/1980 Bulger ..... 180/401
4,197,032 A 4/1980 Miller
4,319,859 A 3/1982 Wise
4,526,493 A 7/1985 Hall et al.
4,726,682 A 2/1988 Harms et al.
4,789,266 A 12/1988 Clarke, Jr. et al.
4,808,026 A 2/1989 Clarke, Jr. et al.
(Continued)

FOREIGN PATENT DOCUMENTS

DE 19951297 C1 4/2001
(Continued)

OTHER PUBLICATIONS

"International Search Report" and "Written Opinion" of the International Search Authority (Korean Intellectual Property Office) in Power Curbers, Inc. et al. mailed on Jul. 7, 2008 and completed on Jul. 7, 2008, for International Patent Application Serial No. PCT/US2008/059516 filed on Apr. 5, 2008, 11 pages.
(Continued)

*Primary Examiner* — James Trammell
*Assistant Examiner* — McDieunel Marc
(74) *Attorney, Agent, or Firm* — Tillman Wright, PLLC; James D. Wright; Chad D. Tillman

(57) ABSTRACT

An automated stringline installation system includes a vehicle, a 3D control system, at least partly carried by the vehicle, for determining location information, and an adjustable arm assembly, mounted on the vehicle, that identifies the location of a relative point in a stringline installation using the location information determined by the 3D control system. The adjustable arm assembly includes an operational arm having a proximal end and a distal end, a string, dispensed from the operational arm, for use in a stringline installation, and a sensor used to determine information pertaining to the location of the distal end of the operational arm assembly relative to the proximal end of the operational arm.

24 Claims, 6 Drawing Sheets

U.S. PATENT DOCUMENTS 4,943,119 A 7/1990 Zarniko et al.
4,961,173 A 10/1990 Sehr et al.
4,988,233 A 1/1991 Kasler et al.
5,035,290 A 7/1991 Harms et al.
5,035,384 A 7/1991 Werthmann
5,046,888 A 9/1991 King
5,051,025 A 9/1991 Taylor, Jr.
5,059,062 A 10/1991 Bresnahan
5,061,115 A 10/1991 Godbersen et al.
5,062,737 A 11/1991 Samuels
5,101,360 A 3/1992 Bennett
5,173,309 A 12/1992 Belarde
5,190,397 A 3/1993 Bengford et al.
5,209,602 A 5/1993 Godbersen
5,258,961 A 11/1993 Sehr et al.
D344,942 S 3/1994 Gilman et al.
5,309,407 A 5/1994 Sehr et al.
5,318,377 A 6/1994 Swisher, Jr. et al.
5,352,063 A 10/1994 Allen et al.
5,405,212 A 4/1995 Swisher, Jr. et al.
5,477,459 A 12/1995 Clegg et al.
5,492,432 A 2/1996 Eben et al.
5,533,888 A 7/1996 Belarde
5,549,412 A 8/1996 Malone
5,553,407 A 9/1996 Stump
5,588,776 A 12/1996 Swisher, Jr. et al.
5,616,291 A 4/1997 Belarde
5,659,985 A 8/1997 Stump
5,662,431 A 9/1997 Colvard
D386,152 S 11/1997 Warneke
5,704,142 A 1/1998 Stump
5,745,074 A 4/1998 Laude
5,791,815 A 8/1998 Rowe
5,862,501 A 1/1999 Talbot et al.
5,903,235 A 5/1999 Nichols
5,924,817 A 7/1999 Godbersen
5,929,807 A 7/1999 Viney et al.
5,935,183 A 8/1999 Sahm et al.
5,941,659 A 8/1999 Godbersen
5,944,770 A 8/1999 Enge et al.
5,951,613 A 9/1999 Sahm et al.
5,977,908 A 11/1999 Nichols
5,984,420 A 11/1999 Murray et al.
5,988,936 A * 11/1999 Smith ..... 404/84.2
6,027,282 A 2/2000 Horn
6,033,031 A 3/2000 Campbell
6,047,227 A 4/2000 Henderson et al.
6,052,083 A 4/2000 Wilson
6,055,486 A 4/2000 Minnich et al.
6,067,046 A 5/2000 Nichols
6,099,204 A 8/2000 Godbersen
6,109,111 A 8/2000 Heimbruch et al.
6,109,825 A 8/2000 Yon
6,119,376 A 9/2000 Stump
6,171,016 B1 1/2001 Pauls et al.
6,171,018 B1 1/2001 Ohtomo et al.
6,191,732 B1 2/2001 Carlson et al.
6,195,922 B1 3/2001 Stump
6,234,713 B1 5/2001 Rowe et al.
6,253,160 B1 * 6/2001 Hanseder ..... 702/95
6,286,607 B1 9/2001 Ohtomo et al.
6,295,746 B1 10/2001 Meduna et al.
6,304,210 B1 10/2001 Allison et al.
6,312,194 B1 11/2001 Simons
6,330,503 B1 12/2001 Sharp et al.
6,332,736 B1 12/2001 Cape et al.
6,364,028 B1 4/2002 Ferrell et al.
6,367,764 B1 4/2002 Butler
6,371,566 B1 4/2002 Haehn
6,384,823 B1 5/2002 Donoghue
6,386,793 B1 5/2002 Lenz et al.
6,421,926 B1 7/2002 Cappuccio
6,425,186 B1 7/2002 Oliver
6,427,441 B2 8/2002 Wustefeld et al.
6,430,504 B1 8/2002 Gilbert et al.
6,457,779 B1 10/2002 Busley et al.
6,467,383 B1 10/2002 Charbonnier
6,467,992 B1 10/2002 Dietrich
6,471,442 B1 10/2002 Deeb et al.
6,477,795 B1 11/2002 Stump
6,481,924 B1 11/2002 Smolders et al.
D467,824 S 12/2002 Svendsen et al.
6,497,531 B2 12/2002 Sipherd et al.
6,508,606 B1 1/2003 James, III et al.
6,520,716 B2 2/2003 Rower
6,529,828 B1 3/2003 Williams et al.
6,540,435 B1 4/2003 Lizarraga
6,577,141 B2 6/2003 Gandrud
6,579,037 B2 6/2003 Guntert et al.
6,582,152 B2 6/2003 Leone et al.
6,587,891 B1 7/2003 Janky et al.
6,594,912 B2 7/2003 Ashjaee
6,628,308 B1 9/2003 Greenberg et al.
6,633,256 B2 10/2003 Zhdanov et al.
6,640,687 B1 11/2003 Frantz et al.
6,655,465 B2 12/2003 Carlson et al.
6,655,869 B1 12/2003 Deeb et al.
6,679,649 B1 1/2004 Capolupo
6,692,185 B2 2/2004 Colvard
6,701,647 B2 3/2004 Stump
6,709,195 B2 3/2004 Piccoli et al.
6,711,838 B2 3/2004 Staub et al.
6,715,957 B2 4/2004 Colvard et al.
6,736,216 B2 5/2004 Savard et al.
D492,306 S 6/2004 Martin et al.
6,772,565 B1 8/2004 Schlitz et al.
6,782,320 B1 8/2004 Bahder
6,791,492 B2 9/2004 Miyasaka et al.
6,799,922 B2 10/2004 Smith
6,805,516 B2 10/2004 Barnat et al.
6,817,253 B2 11/2004 Gandrud
6,837,046 B2 1/2005 Gollner
6,841,100 B2 1/2005 Seppanen
6,849,211 B2 2/2005 Jarvinen et al.
6,862,525 B1 3/2005 Beason et al.
6,871,138 B1 3/2005 Minelli
6,872,028 B2 3/2005 Aeschlimann et al.
6,877,818 B1 4/2005 Gaertner et al.
6,880,643 B1 4/2005 Zimmerman et al.
6,883,815 B2 * 4/2005 Archer ..... 280/91.1
6,890,123 B2 * 5/2005 Piccoli ..... 404/72
6,904,394 B2 * 6/2005 Jaffrey ..... 703/6
6,912,455 B2 6/2005 Beek
6,916,070 B2 7/2005 Sehr
6,923,290 B1 8/2005 MacLeod et al.
6,923,630 B2 8/2005 Allen
6,925,892 B2 8/2005 Gandrud
6,934,631 B2 8/2005 Dentinger et al.
D509,760 S 9/2005 Burrell et al.
6,947,820 B2 9/2005 Ohtomo et al.
6,950,059 B2 9/2005 Rapoport et al.
6,966,387 B2 11/2005 Marriott, Jr. et al.
6,966,859 B2 11/2005 Pollman
6,970,069 B1 11/2005 Murphy
6,971,472 B2 12/2005 Pedersen et al.
6,984,089 B1 1/2006 Colvard
7,003,386 B1 2/2006 Ericsson et al.
7,393,156 B1 7/2008 Dunstan
2003/0074812 A1 4/2003 Stump
2004/0028476 A1 * 2/2004 Payne et al. ..... 405/184
2004/0057795 A1 3/2004 Mayfield et al.
2004/0161299 A1 8/2004 Smith
2004/0168358 A1 9/2004 Stump
2005/0264445 A1 * 12/2005 Brabec et al. ..... 342/357.04
2006/0198700 A1 9/2006 Maier et al.
2007/0058161 A1 3/2007 Nichols et al.
2008/0253834 A1 * 10/2008 Colvard ..... 404/84.05

FOREIGN PATENT DOCUMENTS

JP 2000500195 A 1/2000
JP 2000319815 A 11/2000
JP 2001512543 A 8/2001
KR 1020050115234 A 12/2005
WO 9534849 12/1995
WO 2008124657 A1 10/2008

OTHER PUBLICATIONS

Information Disclosure Statement (IDS) Letter Regarding Common Patent Application(s), dated Aug. 25, 2011.

Information Disclosure Statement (IDS) Letter Regarding Common Patent Application(s), dated Jun. 14, 2011.

* cited by examiner

AUTOMATED STRINGLINE INSTALLATION SYSTEM

CROSS-REFERENCE TO RELATED APPLICATION

The present application is a U.S. nonprovisional patent application of, and claims priority under 35 U.S.C. §119(e) to, each of: U.S. provisional patent application Ser. No. 60/910,247, filed Apr. 5, 2007, U.S. provisional patent application Ser. No. 60/910,243, filed Apr. 5, 2007, and U.S. provisional patent application Ser. No. 60/910,251, filed Apr. 5, 2007, and each of these provisional patent applications is incorporated by reference herein.

COPYRIGHT STATEMENT

All of the material in this patent document is subject to copyright protection under the copyright laws of the United States and of other countries. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE PRESENT INVENTION

1. Field of the Present Invention

The present invention relates generally to the installation of stringlines for guiding construction equipment, and, in particular, to the automated installation of stringlines, for guiding slip form paving machines, using 3D control data.

2. Background

In the construction industry, a longstanding issue has been how to accurately determine, on the construction site, the desired location for a building, road or other construction project as specified in plans developed by an architect, engineer, or the like. Most commonly, surveying techniques, supplemented in recent decades by advances in surveying technology, have been used to pinpoint and mark precise locations on a construction site, thereby guiding construction workers as they work.

Unfortunately, during construction, the locations marked by the surveyors may be affected by the construction process itself. For example, stakes that are laid out by surveyors to mark the edges of a planned road may be moved, covered or destroyed by earth-moving equipment as excavation, fill or the like is carried out. As a result, construction must often be halted temporarily while surveyors reestablish the construction locations, and then the earth-moving process is continued.

More recently, advances in global positioning system ("GPS") technology have begun to find applicability in the construction industry. Perhaps most obviously, GPS technology is now widely used by surveyors in finding locations because it permits actual physical locations to be determined with accuracy to the hundredth of a foot. Because the plans for most construction projects today are developed via computer, such techniques are particularly useful because the plans can be coordinated with the GPS data, thereby providing precise guidance during the surveying process.

In addition, however, GPS has begun to be used to guide the operation of construction equipment during the construction process itself. In fact, the use of so-called three-dimensional ("3D") controls to direct the operation of construction equipment is becoming increasingly common, particularly with regard to earthmoving equipment. A typical implementation of a 3D control system in such a context involves the use of one or more fixed base stations, located in and around the construction site, coupled with a mobile unit disposed on the individual construction equipment that is to be controlled via the system. As described below, the type of control system used may vary, but in each case, the exact position of each base station may be established by conventional surveying means, supplemented by the use of GPS technology.

In one type of 3D control system, the mobile unit is also a GPS unit, and thus the position of the mobile unit, and indirectly, the construction equipment on which it is carried, may be determined with some accuracy using only the mobile unit. The position information provided by the mobile GPS unit by itself is of only limited accuracy. However, in this arrangement, the GPS data developed by the mobile unit may be supplemented and adjusted, as appropriate, using additional GPS data from the fixed base stations, the position of each of which is known with great accuracy. This, in turn, provides highly accurate information about the exact position of the mobile unit, and indirectly, the construction equipment. Such a system is sometimes referred to as a real time kinematic ("RTK") GPS system.

More commonly, however, the base station is a robotic laser-based tracking station, sometimes called a "total station," and the mobile unit includes a prism, wherein the robotic tracking station produces one or more lasers and directs them toward the construction equipment, and more particularly, toward the prism, which is mounted in a prominent location on the construction equipment to maximize its ability to receive the laser. In this type of 3D control system, the laser is used to determine the position of the prism relative to the base station by calculating distance and angle. Because the position of the base station is known, the position of the prism, and indirectly the position of the construction equipment, may be established using the combination of the GPS information developed by the base station and the relative positional information provided using the laser and prism.

For a variety of reasons, however, it is very difficult to use these systems to control equipment such as slip form paving machinery, an example of which is shown in FIG. 1. For one thing, regardless of which type of system is used to determine it, position by itself is not sufficient to control the operation of the equipment. For example, steering a construction machine further requires knowledge of the machine's orientation in two-dimensional space. Conventionally, the machine's orientation is determined indirectly as being closely related to the machine's direction of travel. Currently, determining a machine's travel direction involves comparing the machine's current location, determined via one of the previously-described systems, to its previous location. The vector defined by those two points approximately defines the machine's current direction of travel.

Unfortunately, this approach includes a number of inherent inaccuracies, particularly for curbing machines and other slip form paving machines. First, this approach is dependent upon sufficient movement by the machine in a straightforward direction. The approach cannot work at all if the machine is not moving, because direction of travel cannot be determined in this way if the current location and the previous location are the same. Further, the approach may be highly inaccurate if the current location and the previous location are particularly close to each other, which may happen if the machine is operating in a confined area or is of a type that can spin in place or turn with a very tight turning radius.

Another inaccuracy stems from the fact that machine orientation is not exactly equivalent to direction of travel. For example, it is impossible to determine precisely whether the path traveled by the machine from its previous location to its current location followed a straight line or a curved one. Because the orientation of the machine at the current location will be different if the machine followed a straight line to get there than if it followed a curved one, this uncertainty translates to corresponding uncertainty in the orientation of the machine.

Yet another inaccuracy stems from the use of positional data for only a single point (the point at which the mobile unit is positioned on the machine) to represent the position of the entire machine. In fact, most machines are several meters wide, several meters long and at least a couple of meters high. Because GPS (coupled with one of the systems described above) may be used to determine location to accuracies of considerably less than a meter, the positional data thus determined is accurate only for a small part of the machine, i.e., the exact location of the mobile unit on the machine. The position or location of other parts of the machine, such as the machine's operational components, may be determined only by combining information about the relative disposition of the mobile unit on the machine with knowledge of the geometry of the machine. For machines whose typical use involves travel only in a linear direction, and deviations from such travel occur only infrequently, this approximation may be acceptable. However, for other types of machines that turn regularly, or whose operational components move or are adjusted dramatically relative to the rest of the machine, the error induced between the fixed position of the mobile unit and the position or orientation of the operational components can become dramatic, thus rendering the use of such a system unsuitable for controlling certain types of machines.

The significance of this problem increases in relation to the degree of independence with which the operational components of the machine move relative to the movement of the machine itself. For example, in a curbing machine, the slip forming equipment mounted on the machine is typically adapted to form curbs having very short radiuses of curvature while the machine itself moves forward or stops altogether. When this type of curb is being formed, the movement of the operational components is thus very different from the movement of the machine itself. Conventional systems are ill-equipped to address this issue.

Paving and curbing equipment further require the attitude of the machine side-to-side (generally referred to as "cross slope") and the attitude of the machine front-to-back (generally referred to as "long slope") to be accurately controlled in order to maintain the proper three-dimensional form (side-to-side and front-to-back) of the pavement or curbing being formed. Traditionally, the machine location, direction, and long slope is referenced from a stringline that is placed ahead of time to guide the location of the slip-forming equipment on the machine, while cross slope is monitored by a cross slope sensor. If a 3D control system of one of the types described hereinabove is applied to such equipment, the only information continuously established with regard to the machine is the location of the single mobile unit (most often, a prism); all other information must be extrapolated, with varying degrees of accuracy, or must be developed using other means. For example, the determination of long slope requires an additional sensor over and above the cross slope sensor. Such a sensor is not usually provided on stringline-controlled machines, and thus represents an additional complication in the application of conventional 3D control systems to, for example, paving and curbing machines.

Notwithstanding the foregoing, advances have been made recently in this technology area, including early development of an automated paving machine, as described in co-pending and commonly-assigned U.S. Patent Application No. 60/910,251 ("the '251 patent application"), the entirety of which is incorporated herein by reference, that utilizes a 3D control system for a paving machine. Such advances may address some of the aforementioned problems, but no commercial product has yet to be provided. Moreover, such a 3D control system may be difficult to use while maintaining a high level of accuracy. Furthermore, it might be cost-prohibitive to equip all construction machines on a job site with 3D control systems. For these reasons and others, it may continue to be useful to install and use stringlines for guidance of conventional paving machines, and it would be foolish to ignore the traditional importance of the stringline in establishing, indirectly, the location of other features as well. Conventionally, the stringline is one of the first construction elements put in place on a construction site. Other construction elements are either placed based directly on the stringline or are placed based on the paving structure that is built by the paving machine.

Nonetheless, the benefits of GPS and laser-based 3D systems are apparent. Thus, until accurate 3D control systems for stringline-guided paving machines are widely and economically available, a need exists for a system that utilizes at least some of the benefits of GPS and laser-based 3D systems for aid in pointing to and/or ultimately controlling the placement of physical references such as stakes or stringlines.

SUMMARY OF THE PRESENT INVENTION

Broadly defined, the present invention according to one aspect includes an automated stringline installation system comprising a vehicle; a 3D control system, at least partly carried by the vehicle, for determining location information; and an adjustable arm assembly, mounted on the vehicle, that identifies the location of a relative point in a stringline installation using the location information determined by the 3D control system.

In a feature of this aspect, the relative point is a particular point, on the ground, where a stake is to be installed in a stringline installation. With regard to this feature, the adjustable arm assembly is adapted to install the stake at the particular point. In an additional feature, the relative point is a particular point, elevated over the ground, through which a string is to be installed in a stringline installation. With regard to this feature, the adjustable arm assembly is adapted to position the string such that it is routed through the particular point, and the adjustable arm assembly is adapted to install the string such that is routed through the particular point.

In another feature of this aspect, the automated stringline installation system further comprises a reel assembly for carrying a spool of string such that the string may be routed from the reel assembly to the particular point. In an additional feature, the relative point is a particular point, in an existing stringline installation, whose actual location is to be determined. With regard to this feature, the automated stringline installation system further comprises a database in which the actual location of the particular point is recorded as installed data.

In yet another feature, the adjustable arm assembly includes an operational arm and a translational platform. In accordance with this feature, the translational platform includes a mechanical assembly that permits the operational arm to be displaced, relative to the vehicle, in one or more degree of freedom. With regard to this feature, the operational arm shifts, along at least one axis, relative to the vehicle. With further regard to this feature, the operational arm rotates, around at least one axis, relative to the vehicle. In furtherance of this feature, the mechanical assembly includes a plurality of adjustment mechanisms, each permitting the operational arm to be displaced in exactly one degree of freedom.

In additional features, the adjustable arm assembly includes an articulated arm and the automated stringline installation system further comprises an arm-mounted locator assembly disposed at a distal end of the adjustable arm assembly and arranged to point to the relative point. In another feature, the automated stringline installation system further comprises a sensor used to determine information pertaining to the location of a distal end of the adjustable arm assembly relative to the 3D control system. With regard to this feature, the sensor determines a state or position of an adjustment mechanism in the adjustable arm assembly; the sensor determines a distance or angle of a first portion of the adjustable arm assembly relative to a second portion of the adjustable arm assembly; and the sensor determines a distance or angle between the distal end of the adjustable arm assembly and the 3D control system directly.

In another feature, the 3D control system includes a fixed base station locatable in the general vicinity of the vehicle on a construction site, and a mobile unit carried by the vehicle. In accordance with this feature, the fixed base station is equipped with GPS and the mobile unit includes a GPS unit, and the base station is a robotic laser-based tracking station and the mobile unit includes a prism.

The present invention according to a second aspect includes an automated stringline installation system comprising an operational arm having a proximal end and a distal end; a string, dispensed from the operational arm, for use in a stringline installation; and a sensor used to determine information pertaining to the location of the distal end of the operational arm assembly relative to the proximal end of the operational arm.

In a feature of this aspect, the automated stringline installation system further comprises a machine controller that determines the location of the distal end of the operational arm assembly relative to the proximal end of the operational arm using the information determined by the sensor. In another feature of this aspect, the automated stringline installation system further comprises a geodetic device carried adjacent the proximal end of the operational arm, wherein the machine controller further determines the location of the distal end of the operational arm assembly relative to the geodetic device using the information determined by the sensor. In accordance with this feature, the geodetic device includes a GPS unit and the geodetic device includes a prism.

In an additional feature of this aspect, the sensor determines a state or position of an adjustment mechanism in the operational arm. With regard to this feature, the sensor determines a distance or angle of a first portion of the operational arm relative to a second portion of the adjustable arm assembly, the sensor determines a distance or angle between the distal end of the operational arm and the proximal end of the operational arm directly, and the sensor determines a distance or angle between the distal end of the operational arm and the geodetic device directly.

In yet another feature, the automated stringline installation system further comprises a translational platform supporting the operational arm. With regard to this feature, the translational platform includes a mechanical assembly that permits the operational arm to be displaced in one or more degree of freedom. In accordance with this feature, the operational arm shifts along at least one axis and the operational arm rotates around at least one axis. It is preferred that the mechanical assembly includes a plurality of adjustment mechanisms, each permitting the operational arm to be displaced in exactly one degree of freedom.

In a further feature, the operational arm includes an articulated arm. In a still further feature, the distal end of the operational arm is adapted to identify the location of a relative point in a stringline installation using the location information determined by the sensor. With regard to this feature, the relative point is a particular point, on the ground, where a stake is to be installed in a stringline installation. In accordance with this feature, the operational arm is adapted to install the stake at the particular point. In furtherance of this feature, the relative point is a particular point, elevated over the ground, through which the string is to be installed in a stringline installation. With respect to this feature, the operational arm is adapted to position the string such that it is routed through the particular point and the operational arm is adapted to install the string such that is routed through the particular point. It is preferred that the automated stringline installation system further comprise a reel assembly for carrying a spool of the string such that the string may be routed from the reel assembly to the particular point.

In another feature, the relative point is a particular point, in an existing stringline installation, whose actual location is to be determined. With regard to this feature, the automated stringline installation system further comprises a database in which the actual location of the particular point is recorded as installed data. In an additional feature, the automated stringline installation system further comprises an arm-mounted locator assembly disposed at the distal end of the operational arm and arranged to point to the relative point.

In a yet another feature, the automated stringline installation system further comprises a reel assembly for carrying a spool of the string such that the string may be routed from the reel assembly to the distal end of the operational arm. In accordance with this feature, the automated stringline installation system further comprises a string tensioning device. With regard to this feature, the string tensioning device is disposed at the distal end of the operational arm.

The present invention according to a third aspect includes a method of installing a stringline for guiding construction equipment comprising providing a vehicle having machine controller, including a memory, and an adjustable arm assembly mounted thereon, the adjustable arm assembly having a proximal end and a distal end; storing data representative of a desired location for a stake in the memory, the stake being a stake in a stringline installation; driving the vehicle in the immediate vicinity of the desired stake location; automatically determining an actual location indicated by the distal end of the adjustable arm assembly; comparing the actual location of the distal end of the adjustable arm assembly to the desired stake location stored in the memory; and installing a stringline stake in the actual location indicated by the distal end of the adjustable arm assembly according to the outcome of the comparing step.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Further features, embodiments, and advantages of the present invention will become apparent from the following detailed description with reference to the drawings, wherein.

DETAILED DESCRIPTION OF THE PREFERRED EMBODIMENTS

Figure 1:
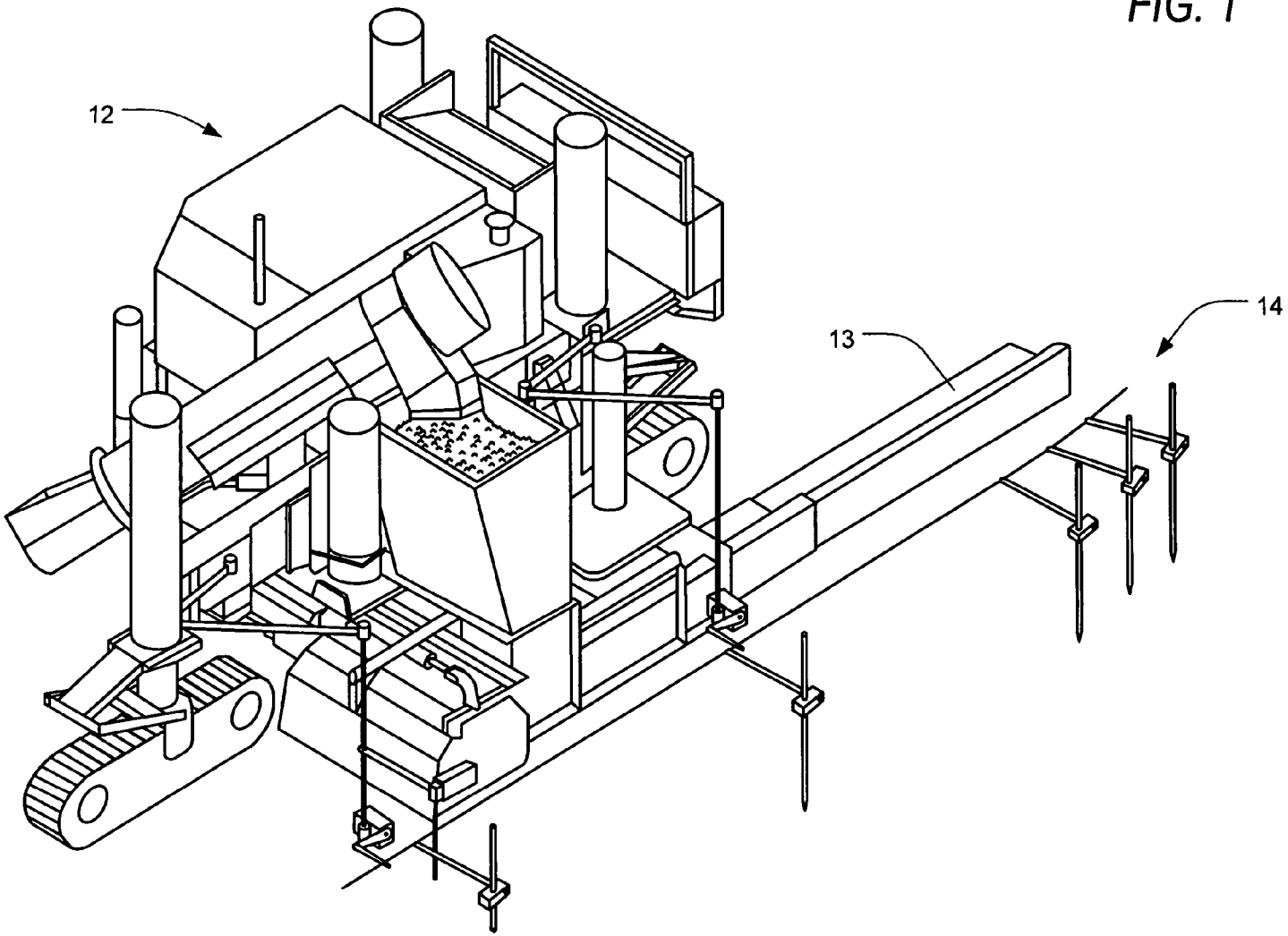
FIG. 1 is a perspective view of a conventional slip form paving machine in operation using a stringline.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, in which like numerals represent like components throughout the several views, the preferred embodiments of the present invention are next described. The following description of the preferred embodiment(s) is merely exemplary in nature and is in no way intended to limit the invention, its application, or uses.

FIG. 1 is a perspective view of a conventional slip form paving machine 12 in operation using a stringline 14. Although slip form paving machines 12 may be used to install a wide variety of projects, the paving machine 12 in FIG. 1 is shown being used to install a curb and gutter 13 for a road. For a curb and gutter project, the stringline 14 runs parallel to the intended location of the curb and gutter installation 13, and the paving machine 12 operates using the stringline 14 to guide it. The placement of the stringline 14 is thus very important. Because the curb and gutter 13 is often the first element placed in an area of new construction, and other elements, such as the road surface and subsurface, drains, and other construction features, are installed based on the location of the curb and gutter 13, the placement of the stringline 14 is thus even more important.

Figure 2:
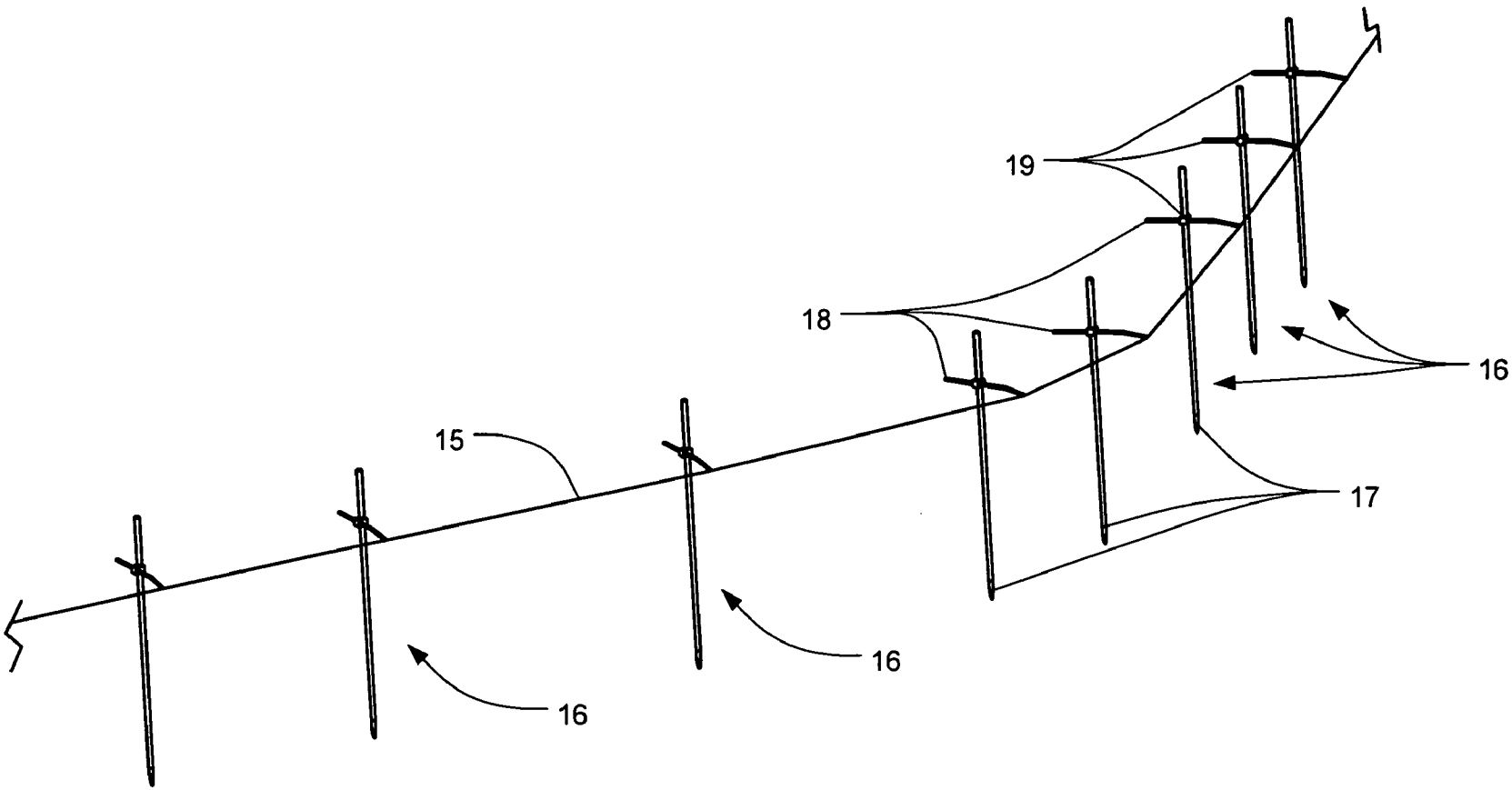
FIG. 2 is a perspective view of a stringline similar to the stringline of FIG. 1.

FIG. 2 is a perspective view of a stringline 14 similar to the stringline of FIG. 1. As shown therein, the stringline 14 includes a string 15 supported by a plurality of line holders 16. Each line holder 16 conventionally includes a pin or stake 17 that is driven into the ground, a rod 18 extending laterally from the stake 17, and a clamp 19 for adjustably connecting the rod 18 to the stake 17. Line holders 16 are sometimes referred to herein as "stake and rod assemblies."

Figure 3:
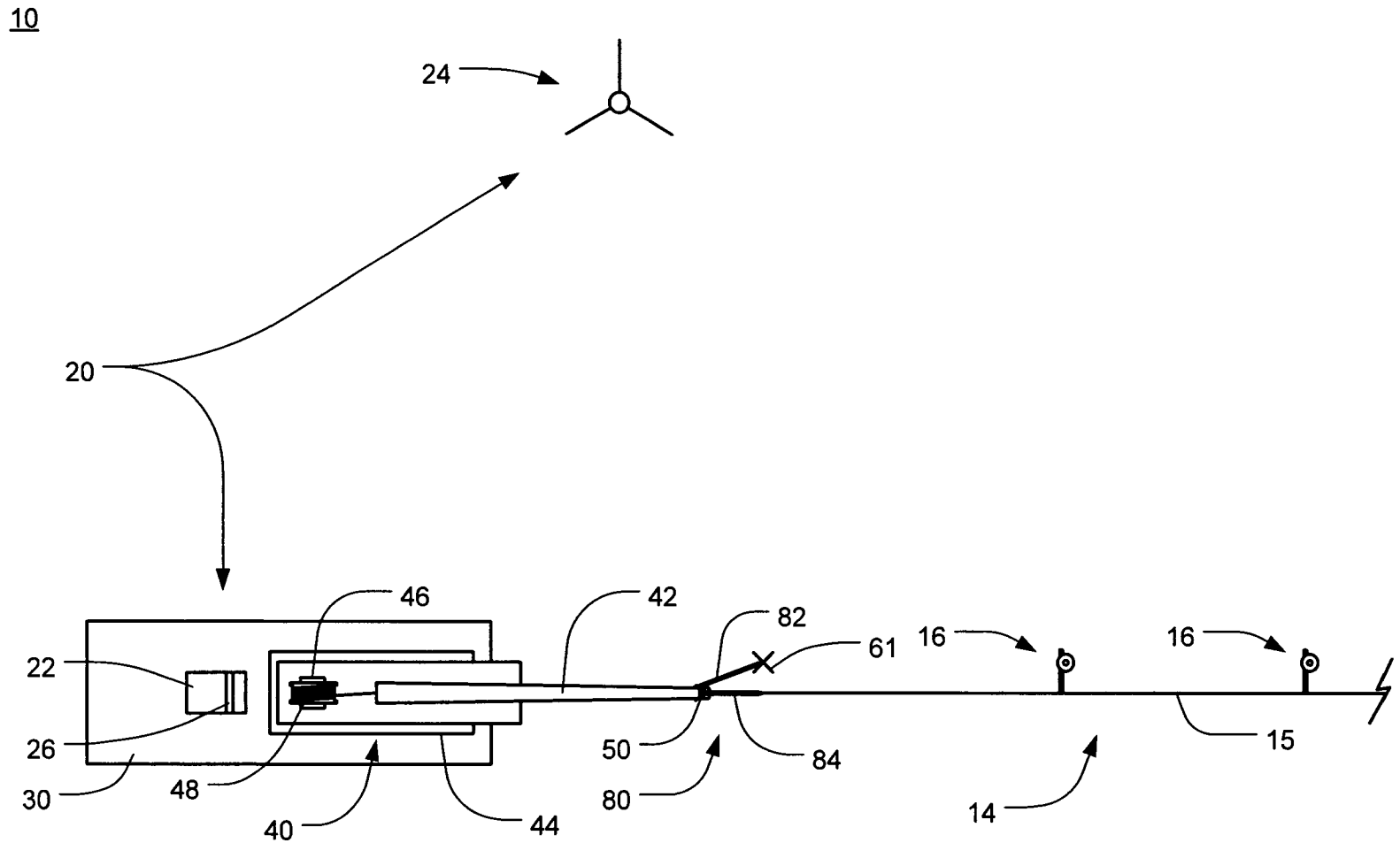
FIG. 3 is a top schematic diagram of an automated stringline installation system in accordance with a first preferred embodiment of the present invention.
Figure 4:
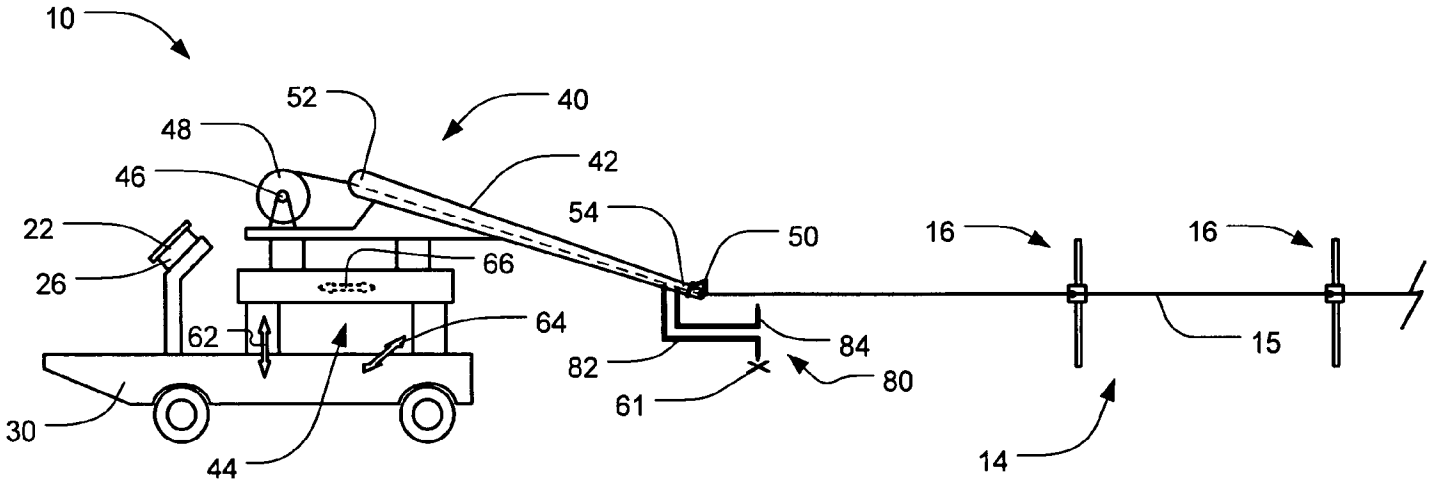
FIG. 4 is a side schematic diagram of the automated stringline installation system of FIG. 3.

FIGS. 3 and 4 are a top and side schematic diagram, respectively, of an automated stringline installation system 10 in accordance with a first preferred embodiment of the present invention. As shown, the automated stringline installation system 10 includes a 3D control system 20, a vehicle 30 and an automated arm assembly 40. Each of these components will be described in greater detail hereinbelow.

The 3D control system 20 includes a mobile unit 22, a base station 24, a machine controller 26 and a user interface (not shown). The 3D control system 20 may be either a conventional GPS-only system or a conventional laser-based tracking system, each of which is well known to the Ordinary Artisan but is described in some detail herein. In summary, in a GPS-only system, the base station 24 and mobile unit 22 are each GPS-equipped, and the mobile unit 22 utilizes GPS information from the base station 24 to provide a more accurate determination of location. As noted previously, such a system is sometimes referred to as an RTK GPS system. In a laser-based tracking system, the base station 24 is a robotic laser-based tracking station or total station, and the mobile unit 22 is equipped with a prism. In either case, positional data is relayed to the machine controller 26, which includes a data processor/comparator or the like, converts positional data developed by the mobile unit 22 and base station 24 into control information for navigating the vehicle 30. The mobile unit 22 may be designed to be compatible with conventional GPS base station products in order to reduce the cost of developing the system 20 and to reduce implementation costs for operators of slip form paving machines 12.

Although shown only schematically, the vehicle 30 may be any suitable transportation device capable of carrying the other components while traversing the general course along which the stringline 14 is to be installed. Accordingly, although the vehicle 30 need not follow the stringline course precisely (i.e., the operation of the automated arm assembly 40, described below, provides some tolerance), the vehicle 30 needs to be capable of navigating a path that mimics the course within the tolerance provided by the automated arm assembly 40. Such a course may be calculated automatically by the machine controller 26, or it may determined manually by the operator. In at least one embodiment, preferred for its ease of implementation, the vehicle 30 is a pick-up truck that may or may not be pulling a trailer. In this embodiment, the automated arm assembly 40 may be mounted in the cargo bed of the pick-up, and the user interface may be mounted in the cab of the pick-up for ready access by the driver/operator. The trailer may be particularly suited to carrying stringline stake and rod assemblies 16 for ready supply during the stringline installation process. In at least one other embodiment, the vehicle 30 is a custom-built or custom-modified vehicle having four-wheel steering for more precise navigational ability. The design and implementation of such a vehicle 30 will be within the skill of the Ordinary Artisan.

The user interface includes such elements as are necessary to provide appropriate feedback and control. The user interface may include, for example, at least one display, one or more indicators, and one or more system controls. A 3D display may be included in order to provide the operator with a three-dimensional indication of the location of the vehicle 30, the mobile unit 22, the automated arm assembly 40, or any combination thereof. A video display, linked to a video camera or the like stationed in proximity to the automated arm assembly 40, may be included to provide the operator with one or more images of the actual operation of the arm assembly 40 for verification purposes, manual control, or the like. Indicators may include appropriate audio and/or visual indicators for providing the operator with status information, to indicate the proximity of the vehicle and/or the arm assembly 40 to a desired location 61 in the stringline 14, or the like. For example, an audio indicator might change pitch and intensity as the operator moves closer to a stake location 61, similar to the operation of audio indicators used in metal detectors and satellite antenna pointing equipment, and visual indicators might be configured to provide directional and distance information using LED light bars or a compass style pointing mechanism so the operator can adjust the vehicle's speed and direction when approaching a stake location 61. Finally, system controls may include all those necessary to activate and operate the system 10, to access site plan data, and the like.

The automated arm assembly 40 includes an operational arm 42, a translational platform 44 for adjusting the position and/or orientation of the arm 42, a reel assembly 46 on which is mounted a spool 48 of string 15, and an optional string tensioning device 50. The reel assembly 46 and a proximal end 52 of the arm 42 are mounted on the translational platform 44 such that string 15 from the spool 48 may be unwound and routed through or along the arm 42 to its distal end 54, from whence the stringline 14 may be installed according to the desired stringline design. Although shown only schematically, the operational arm 42 itself may take on any convenient form, but should be rigid enough to permit the precise position of the distal end 54 to be accurately determinable relative to the platform 44 and/or the vehicle 30, and particularly relative to the mobile unit 22 of the 3D control system 20.

Figure 5:
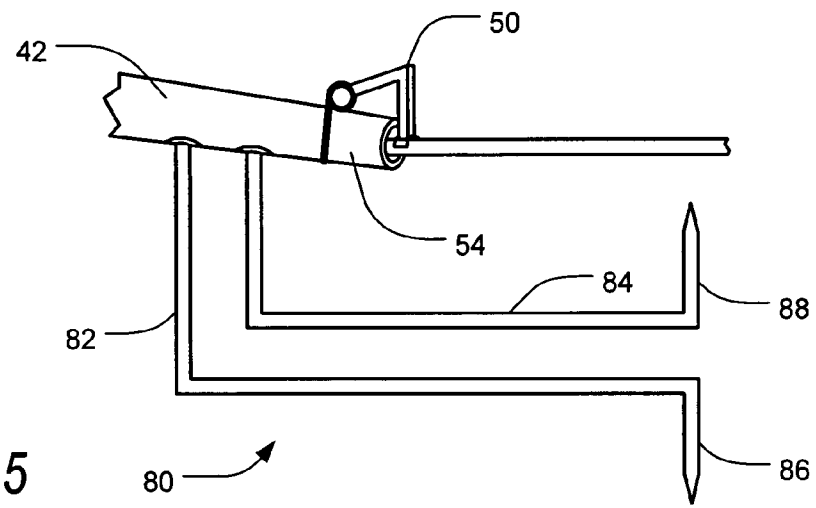
FIG. 5 is an enlarged portion of the schematic diagram of FIG. 4 showing the distal end of the operational arm.

Although the route of the string 15 from the reel assembly 46 to the distal end 54 of the operational arm 42, and from there to the stakes 17 of the stringline installation, inherently creates tension in the string 15, this tension is preferably controlled using a conventional tensioning device 50. FIG. 5 is an enlarged portion of the schematic diagram of FIG. 4 showing the distal end 54 of the operational arm 42. The tensioning device 50 permits the level of tension in the string 15 to be maintained at a relatively constant level. In particular, the tension may be maintained at a level sufficient to hold the string 15 in place and to ensure that any attachment means utilized by the line holders 16 to hold the string 15 are accurately connected. In addition, the tension may be sufficient to support an optional stake locator device 56, described below, hung therefrom.

The translational platform 44 is a mechanical assembly that permits the operational arm 42 to be displaced (shifted or rotated) in one or more degree of freedom (i.e., shifted along one or more axis, rotated about one or more axis, or the like), or any combination thereof, depending upon its implementation. In the embodiment illustrated in FIG. 4, the translational platform 44 permits the arm 42 to be shifted up and down using a first adjustment mechanism 62, shifted left or right using a second adjustment mechanism 64, and optionally shifted forward and back using a third adjustment mechanism 66. Preferably, each adjustment mechanism 62,64,66 includes a sensor for determining the actual state or position of the respective adjustment mechanism. Alternatively, one or more independent sensors may be used to determine the relative position of the distal end 54 of the operational arm 42 more directly. The sensor readings may thus be used by the machine controller 26 to determine, taking into consideration the geometry of the arm 42 and the platform 44, the position of the operational arm's distal end 54 relative to the mobile unit 22, any fixed point on the main body of the vehicle 30 or any fixed structure mounted thereon. Furthermore, the actual position of the distal end 54 may be determined by applying this relative positional information to the vehicle's actual position as determined by the 3D control system 20.

Figure 6:
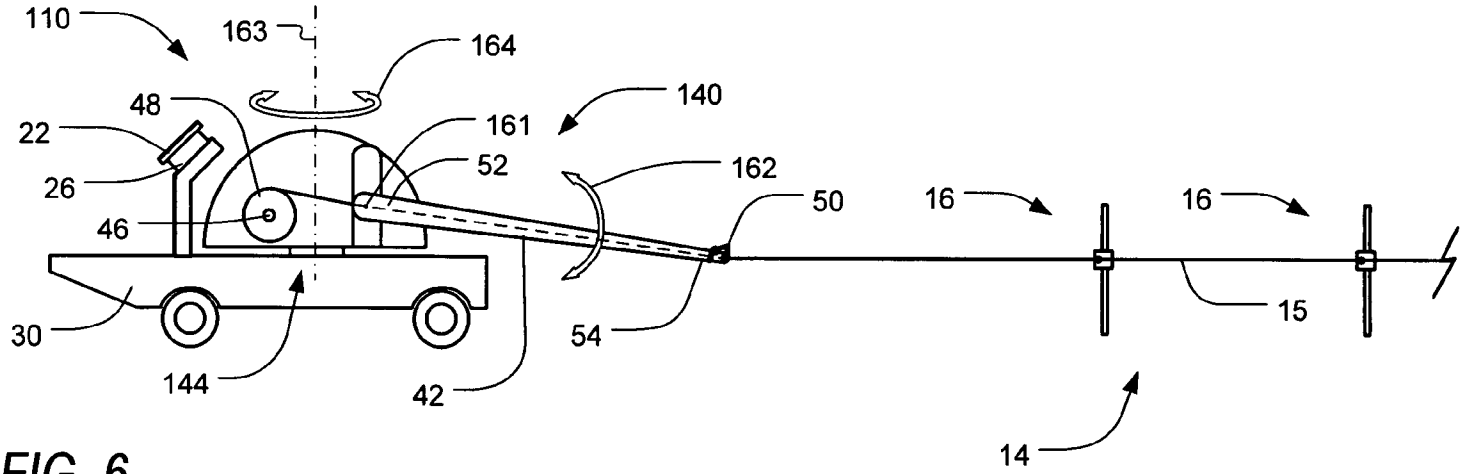
FIG. 6 is a side schematic diagram of an automated stringline installation system in accordance with a second preferred embodiment of the present invention, illustrating an alternative automated arm assembly and translational platform.

FIG. 6 is a side schematic diagram of an automated stringline installation system 110 in accordance with a second preferred embodiment of the present invention, illustrating an alternative automated arm assembly 140 and translational platform 144. In this embodiment, the translational platform 144 permits the arm 42 to be rotated around a first axis 161 using a first adjustment mechanism 162, or rotated around a second axis 163 using a second adjustment mechanism 164. As with the translational platform 44 of FIG. 4, each adjustment mechanism 162,164 preferably includes a sensor for determining the actual state or position of the respective adjustment mechanism. The sensor readings may thus be used by the machine controller 26 to determine actual position of the distal end 54 of the operational arm 42, once again taking into consideration the geometry of the arm 42 and the platform 144.

Although not illustrated, the Ordinary Artisan will understand that still other mechanical structures may be utilized to accomplish similar purposes without departing from the scope of the present invention. For example, some or all of the elements of the automated arm assembly 40 to be replaced with an articulated operational arm whose various operational elements can be cooperatively controlled to maneuver the distal end thereof as desired, and information from sensors corresponding to those described previously may be used to determine the actual position of the distal end by applying the relative positional information derived therefrom to the vehicle's actual position as determined by the 3D control system 20. In at least one aspect of the present invention, the design of the automated arm assembly 40 is not important; the ability to position the distal end of the assembly 40 in a desired location is.

In use, stringline data is derived from conventional 3D design and modeling software systems used by engineering and contracting firms in the road/real estate development industry. Site plan data is output from such systems in a preferably standard file format, and the data for the stringline portion of the design is extracted and the appropriate offset for the stringline position, relative to the project itself, is established. For example, for a curb and gutter project 13, the curb and gutter design is extracted from the database and a Top Back of Curb ("TBOC") offset for the stringline position is established based upon a curb-and-gutter contractor's field operation requirements. Next, the stake locations 61 necessary to insure proper stringline positioning are determined, either automatically or manually. For example, stake locations 61 around a curve may be determined based on based upon a rule that limits the chord effect of stringline 14 such that a stake 17 would be required every x feet for a radius of y feet.

The stake placements 61 so determined may be reviewed by a curb-and-gutter contractor's data management specialist to insure compliance with any required field operations rules and site specific circumstances. For example, stake placement may also be affected by slope changes and other infrastructure elements or factors on the work site. The resulting stringline 3D data file would then be converted into a machine control format necessary to operate the automated stringline installation system 10 at the construction site, and the resulting control data is loaded into the machine controller 26.

Based upon GPS positioning relative to the stringline design, as established in the 3D data file, an operator drives the vehicle 30 in the area of stringline installation. The operator positions the vehicle 30 within a specified operating area, defined by the operational reach of the automated arm assembly 40, adjacent the next stake placement defined in the stringline data file. Positioning may be accomplished manually, either in accordance with information provided by the machine controller 26 or by dead reckoning, or may be accomplished automatically under the control of the machine controller 26 or a related component. It is contemplated that positioning the vehicle 30 within a radius of three feet around the desired stringline stake position 61 will be sufficient. In maneuvering the vehicle 30 into position, the operator may use the visual and audio indicators provided by the user interface as described previously.

Upon reaching the necessary vehicle position, the operator stops the vehicle 30 and preferably places it into a "locked" position or state. Using the translational platform 44, the position of the distal end 54 of the operational arm 42 may be adjusted until it reaches a desired location, the desired location being established according to any of a variety of predetermined criteria as more fully described below. For example, in one or more embodiments, the desired location of the end of the operational arm 42 is a point relatively close to a desired stake location 61 for the stringline 14 being installed. While maintaining the end of the operational arm 42 in place, the operator determines the precise location 61 on the ground at which the next stake 17 is to be placed. Such determination may be made manually or automatically as further described hereinbelow. The operator or the assistant may then drive a stake 17 into the ground at the identified location 61 using conventional means.

During this process, the operational arm 42 also maintains the position of the string 15. Thus, once the stake 17 is in place, the disposition of the rod 18 may be readily adjusted by manipulating the clamp 19 until the string-holding end of the rod 18 is located at the necessary height, distance from the stake 17, and orientation. Once so arranged, the string 15 may then be easily mounted on the rod 18 using conventional means. When the process is complete, the operator may then remove the vehicle 30 from its "locked" position or state and drive it to the next stake location. The process is then repeated for each stake location 61 in the design.

Precise stringline locations, such as stake locations 61 and string/rod interconnection locations, may be determined in a variety of ways. In the embodiment illustrated in FIGS. 3-5, an arm-mounted locator assembly 80 is disposed at the distal end 54 of the operational arm 42 for use in identifying particular locations relevant to the installation of a stringline 14. As perhaps best illustrated in FIG. 5, the arm-mounted locator assembly 80 includes two locator arms 82,84, each having a respective pointer device 86,88 disposed at the distal end thereof. It will be appreciated that the locator arms 82,84 shown in the various illustrations are exemplary only and that the exact design and construction thereof may be varied substantially without departing from the scope of the present invention. Furthermore, it will be appreciated that the two locator arms 82,84 could be combined into a single structure having two pointer devices, or that the two locator arms 82,84 could be combined into a single structure, having only a single pointer device, whose position and/or orientation is adjustable, such as by swiveling, extending, or the like, so that the single pointer device may be used to point to different locations without adjusting the operational arm 42. In all cases, however, the geometric relationship between the pointer device or devices 86,88 and the position of the machine controller 26 is either known or can be determined.

In operation, the arm-mounted locator assembly 80 can be used to identify specific locations on the ground, such as stake locations 61, or specific points along a string 15, such as the points at which the string 15 is to be attached to respective rods 18. More particularly, the machine controller 26 may adjust the position of the operational arm 42, and if appropriate the arm-mounted locator assembly 80 itself, as necessary such that the first locator arm 82 (and more particularly, the pointer device 86 at the distal end thereof) points downward to the precise location 61 on the ground at which the next stake 17 is to be placed. Similarly, the machine controller 26 may adjust the position of the operational arm 42, and if appropriate the arm-mounted locator assembly 80 itself, as necessary such that the second locator arm 84 (and more particularly, the pointer device 88 at the distal end thereof) points upward to the precise location along the string 15 where the next rod 18 is to be connected thereto. In at least some embodiments, the first pointer device 86 points to the stake location 61 while the second pointer device 88 simultaneously points to the rod connection point, thereby permitting an operator to install the stake 17 and the rod 18 and connect the string 15 without having to reposition the vehicle 30 or the operational arm 42.

Figure 7:
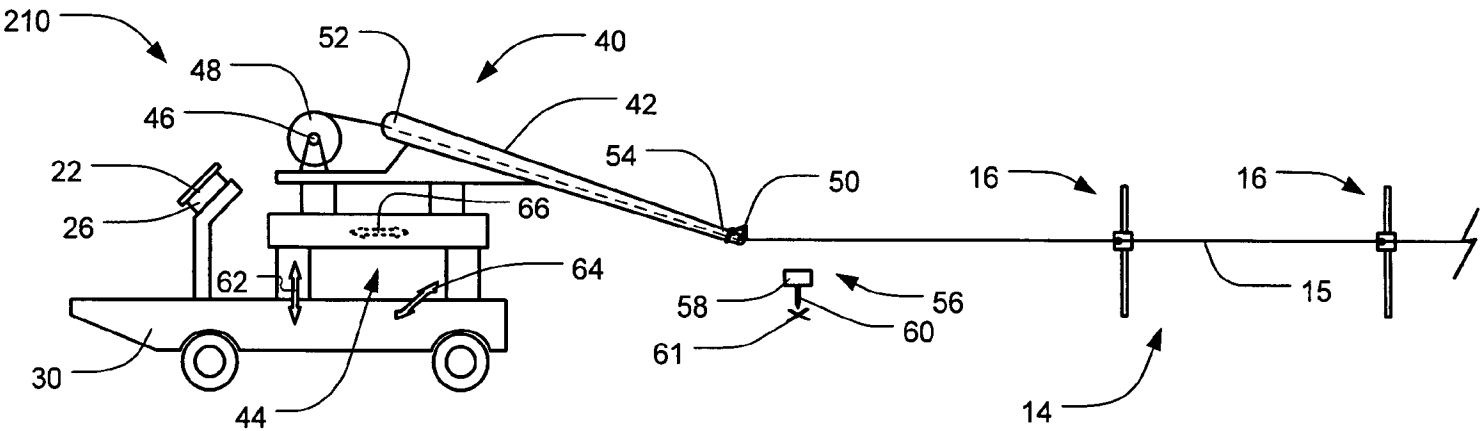
FIG. 7 is a side schematic diagram of an automated stringline installation system in accordance with a third preferred embodiment of the present invention, shown in use with a first portable locator device.
Figure 8:
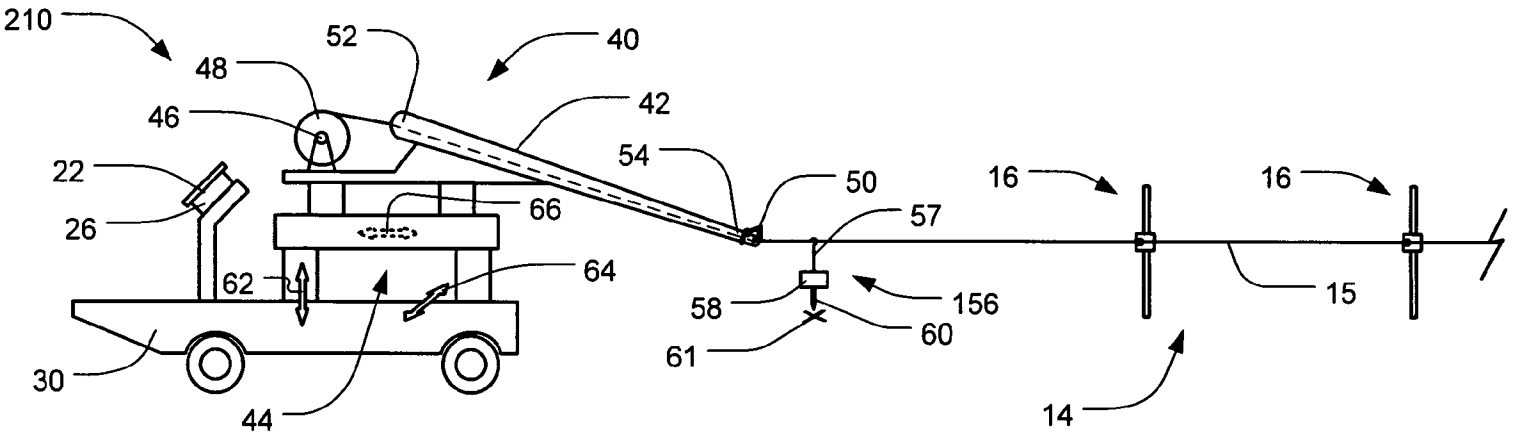
FIG. 8 is a side schematic diagram of the automated stringline installation system of FIG. 7, shown in use with a second portable locator device.

In a simpler arrangement, illustrated in FIGS. 7 and 8, any of various handheld stringline locator devices 56,156 may be used to identify stake locations 61 and rod connection points independently from the operation of the vehicle 30, operational arm 42 and machine controller 26. More particularly, FIGS. 7 and 8 are side schematic diagrams of an automated stringline installation system 210 in accordance with a third preferred embodiment of the present invention, shown in use with first and second portable locator devices 56,156, respectively. As shown in FIG. 7, a first locator device 56 includes at least a leveling device (not shown), such as a bubble level, a geodetic device 58, such as a GPS unit or an optical prism for use with a robotic laser-based tracking station, and means for indicating stake location, such as a mechanical or laser pointer 60. The locator device 56 may be manually maneuvered by the operator or another worker to a location that is in the vicinity of where the next stake 17 in the stringline 14 is to be placed, and then repeatedly repositioned until some sort of indication is provided that it has been placed in exactly the right position. The pointer 60 then indicates the precise location 61 for a stake 17 to be placed. As shown in FIG. 8, another locator device 156 includes at least a hook 57 or other means for hanging the device 156 on the string 15, a geodetic device 58, such as a GPS unit or an optical prism for use with a robotic laser-based tracking station, and means for indicating stake location, such as a mechanical or laser pointer device 60. The locator device 156 may be manually hung on the string 15, by a worker, at a location that is in the vicinity of where the next stake 17 in the stringline 14 is to be placed, and then repeatedly repositioned until some sort of indication is provided that it has been placed in exactly the right position. The pointer device 60 then indicates the precise location 61 for the string 15 is to be connected to a rod 18, and a stake 17 may be placed nearby in such a location as can support the rod 18 in the proper location. One or more examples of locator devices suitable for use with the present invention are disclosed in co-pending and commonly-assigned U.S. Patent Application No. 60/910,251, the entirety of which is incorporated herein by reference.

Figure 9:
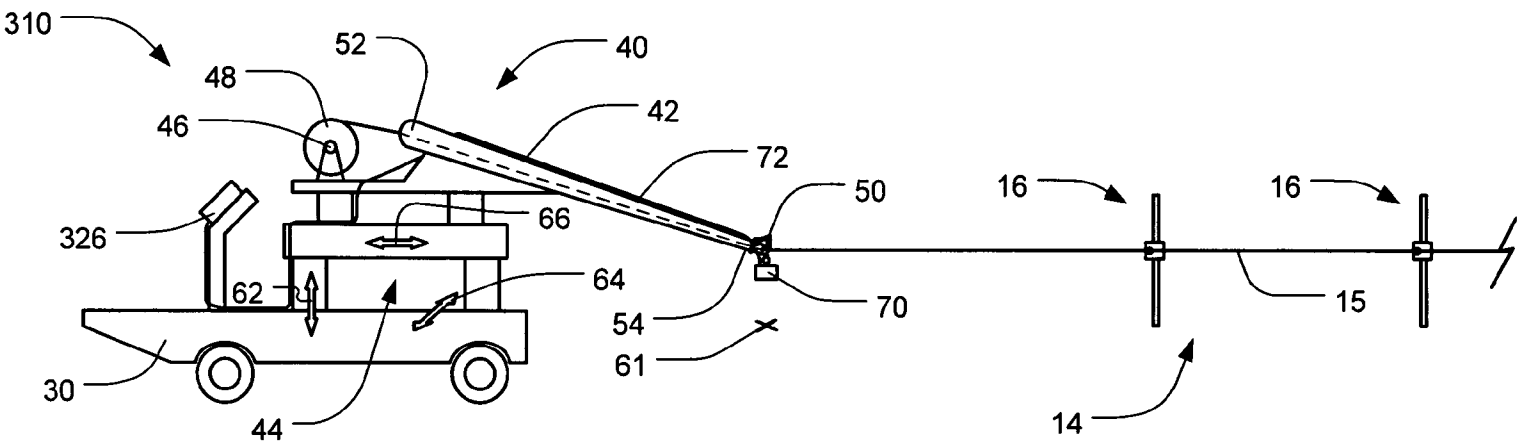
FIG. 9 is a side schematic diagram of an automated stringline installation system in accordance with a fourth preferred embodiment of the present invention.

FIG. 9 is a schematic diagram of an automated stringline installation system 310 in accordance with a fourth preferred embodiment of the present invention. As shown therein, a geodetic device 70, such as a GPS unit or an optical prism for use with a robotic laser-based tracking station, may be located at the end of the operational arm 42. By connecting the device 70 to a machine controller 326 via a communications cable 72 or the like, the geodetic device 70 may be substituted for the one otherwise supplied with the machine controller 26 of the system 10 of FIGS. 3 and 4. In such an arrangement, the sensors described previously with regard to the translational platform 40 may be used to derive the location of the vehicle 30 relative to the geodetic device 70 and may thus be used to control the movements of the vehicle 30.

Alternatively, in still another preferred embodiment (not shown), the machine controller 26 of FIGS. 3 and 4 may be used to control the movements of the vehicle 30, and is supplemented with data from the geodetic device 70 at the end of the operational arm 42 for determining the location of the geodetic device 70 itself. For example, as described in the '251 patent application, it is difficult to determine the direction of travel or orientation of a construction machine or other vehicle from only a single geodetic device mounted on the vehicle. Comparison of the exact location of the geodetic device 70 at the end of the operational arm 42 with the exact location of the mobile unit 22, coupled with geometric information as described previously, can provide information about whether the vehicle is inclined upward or downward. Conversely, the exact location of the end of the operational arm 42 could be determined based on the exact location of the mobile unit 22 coupled with separately-determined information about the incline (slope) of the vehicle, such as may be determined by a conventional slope sensor. These types of determinations may be particularly useful when one of the systems 10,110,210,310 of the present invention is being used on hilly or uneven ground.

Although likewise not illustrated, it will be appreciated that any of these arrangements may be supplemented with an arm-mounted locator assembly 80 as described in FIGS. 3-5 and accompanying text.

In at least some embodiments of the present invention, the process of driving a stake 17 into the ground at each location 61 indicated by the arm-mounted locator assembly 80 may be automated. For example, when the vehicle 30 reaches the vicinity of a new stake location, the vehicle 30 may be stopped and placed into a "locked" state and the operational arm 42 may be loaded with a stake and rod assembly 16. Loading the operational arm 42 may be accomplished manually or automatically by removing a stringline stake and rod assembly 16 from a trailer optionally pulled behind the vehicle 30 or from any other suitable carrying location. The operational arm 42 may then place the stake 17 in the proper location 61 with the proper orientation, and drive the stake 17 into the ground. The automated arm assembly 40 must at least be capable of a positioning accuracy such that the stake placement is within the adjustment range of the stringline rod 18. Initially, it is contemplated that placing and driving the stake 17 within a radius of one foot around the desired stringline stake position 61 will be sufficient.

Once again, during this process, the operational arm 42 also maintains the position of the string 15. Thus, once the stake 17 is in place, the disposition of the rod 18 may be readily adjusted by manipulating the clamp 19 until the string-holding end of the rod 18 is located at the necessary height, distance from the stake 17, and orientation. Once so arranged, the string 15 may then be easily mounted on the rod 18 using conventional means. When the process is complete, the operator may then remove the vehicle 30 from its "locked" position or state and drive it to the next stake location. The process is then repeated for each stake location 61 in the design.

In at least some embodiments of the present invention, the stake location 61 identified by the arm-mounted locator assembly 80 is known, at least relative to the distal end 54 of the operational arm 42, and thus this location 61 may be recorded as installed data for "as-built" documentation.

Alternatively, a robotic method of precisely installing the string 15 in conjunction with the robotic installation of the stakes 17 may be developed and applied. Preferably, the stakes 17 are placed and the string 15 attached in the precise location during a single pass through the installation area. In order to achieve this type of operation, the geometry between the stake 17, rod 18, and string 15 must be controlled. This control can be implemented with either fixed geometry between the parts of the stringline 14, such that the geometry is consistent and predictable, or with means to manipulate the geometries from detectable and measurable positions to stable and calculable positions with the required accuracy, even after use in harsh field environments. It is contemplated that positioning accuracy within +/−0.125 inches will be sufficient. In other words, the string-holding end of each rod 18 must be placed within an eighth of an inch of its intended location. Once the stake and rod assembly 16 is installed with the string-holding end of the rod 18 in the proper location, the string 15 may be automatically attached or mounted within the rod's holding slot. Further, a system for such automatic installation preferably includes means for tying-off and tensioning the string 15 such that it maintains its position when in use guiding the operation of a conventional slip form paving machine 12.

Once the stringline 14 has been fully installed, using any of the systems 10,110,210,310 or variations thereof described above, a conventional slip form paving machine 12 may be operated to form the desired curb and gutter installation 13, as shown in FIG. 1. When finished, the respective vehicle 30 may be driven back into the area of the stringline 14 to be removed and positioned adjacent one of the stake and rod assemblies 16. The precise position of the stake and rod assembly 16 is known from the as-built documentation gathered during the installation process. It is not necessary for the vehicle 30 to be positioned perfectly relative to the stake 17, because the automated arm assembly 40 may be translated as described previously, thereby permitting more precise adjustment. The operational arm 42 may then be used to remove the stake and rod assembly 16 from the ground and return it to the trailer or other storage location from which it came. Meanwhile, the string 15 may be rewound onto the spool 48. This process may then be repeated until all of the stake and rod assemblies 16 have been removed and stored. In at least one method of operation, the stake and rod assemblies 16 are removed in the reverse order that they were installed; that is, the last stake and rod assembly 16 installed is the first removed, and so on.

Based on the foregoing information, it is readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to its preferred embodiment, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements; the present invention being limited only by the claims appended hereto and the equivalents thereof. Although specific terms are employed herein, they are used in a generic and descriptive sense only and not for the purpose of limitation.

What is claimed is:

1. An automated stringline installation system, comprising:

a vehicle;

a 3D control system, at least partly carried by the vehicle, for determining location information; and an adjustable arm assembly, mounted on the vehicle, that identifies the location of a relative point in a stringline installation using the location information determined by the 3D control system.

2. The automated stringline installation system of claim 1, wherein the relative point is a particular point, on the ground, where a stake is to be installed in a stringline installation.

3. The automated stringline installation system of claim 2, wherein the adjustable arm assembly is adapted to install the stake at the particular point.

4. The automated stringline installation system of claim 1, wherein the relative point is a particular point, elevated over the ground, through which a string is to be installed in a stringline installation.

5. The automated stringline installation system of claim 4, wherein the adjustable arm assembly is adapted to position the string such that it is routed through the particular point.

6. The automated stringline installation system of claim 5, wherein the adjustable arm assembly is adapted to install the string such that is routed through the particular point.

7. The automated stringline installation system of claim 5, further comprising a reel assembly for carrying a spool of string such that the string may be routed from the reel assembly to the particular point.

8. The automated stringline installation system of claim 1, wherein the relative point is a particular point, in an existing stringline installation, whose actual location is to be determined.

9. The automated stringline installation system of claim 8, further comprising a database in which the actual location of the particular point is recorded as installed data.

10. The automated stringline installation system of claim 1, wherein the adjustable arm assembly includes an operational arm and a translational platform.

11. The automated stringline installation system of claim 10, wherein the translational platform includes a mechanical assembly that permits the operational arm to be displaced, relative to the vehicle, in one or more degree of freedom.

12. The automated stringline installation system of claim 11, wherein the operational arm shifts, along at least one axis, relative to the vehicle.

13. The automated stringline installation system of claim 11, wherein the operational arm rotates, around at least one axis, relative to the vehicle.

14. The automated stringline installation system of claim 11, wherein the mechanical assembly includes a plurality of adjustment mechanisms, each permitting the operational arm to be displaced in exactly one degree of freedom.

15. The automated stringline installation system of claim 1, wherein the adjustable arm assembly includes an articulated arm.

16. The automated stringline installation system of claim 1, further comprising an arm-mounted locator assembly disposed at a distal end of the adjustable arm assembly and arranged to point to the relative point.

17. The automated stringline installation system of claim 1, further comprising a sensor used to determine information pertaining to the location of a distal end of the adjustable arm assembly relative to the 3D control system.

18. The automated stringline installation system of claim 17, wherein the sensor determines a state or position of an adjustment mechanism in the adjustable arm assembly.

19. The automated stringline installation system of claim 17, wherein the sensor determines a distance or angle of a first portion of the adjustable arm assembly relative to a second portion of the adjustable arm assembly.

20. The automated stringline installation system of claim 17, wherein the sensor determines a distance or angle between the distal end of the adjustable arm assembly and the 3D control system directly.

21. The automated stringline installation system of claim 1, wherein the 3D control system includes a fixed base station locatable in the general vicinity of the vehicle on a construction site, and a mobile unit carried by the vehicle.

22. The automated stringline installation system of claim 21, wherein the fixed base station is equipped with GPS and the mobile unit includes a GPS unit.

23. The automated stringline installation system of claim 21, wherein the base station is a robotic laser-based tracking station and the mobile unit includes a prism.

24. An automated system for installing a stringline that may subsequently be utilized to guide a paving machine during operation thereof, comprising:

a vehicle;

a 3D control system, at least partly carried by the vehicle, for determining geodetic information regarding the location of at least a portion of the vehicle; and an adjustable arm assembly, mounted on the vehicle, that uses the geodetic location information determined by the 3D control system to identify the location of a point in the stringline that is being installed, thereby facilitating the installation of the stringline.

* * * * *